US005161550A

United States Patent [19]

Owens, Jr.

[11] Patent Number: 5,161,550

[45] Date of Patent: Nov. 10, 1992

[54] WRAPPERS FOR SMOKING ARTICLES, METHODS OF MAKING SUCH WRAPPERS AND SMOKING ARTICLES MADE FROM SUCH WRAPPERS—CASE V

[75] Inventor: William F. Owens, Jr., Pisgah Forest, N.C.

[73] Assignee: P. H. Glatfelter Company, Spring Grove, Pa.

[21] Appl. No.: 756,544

[22] Filed: Sep. 9, 1991

Related U.S. Application Data

[63] Continuation-in-part of Ser. No. 514,533, Apr. 26, 1990.

[51] Int. Cl.[5] ..... A24D 1/02

[52] U.S. Cl. ..... 131/365

[58] Field of Search ..... 131/365

[56] References Cited

U.S. PATENT DOCUMENTS 4,450,847 5/1984 Owens ..... 131/365

FOREIGN PATENT DOCUMENTS 0804351 1/1969 Canada ..... 131/365

OTHER PUBLICATIONS

Leffingwell et al., "Tobacco Flavoring for Smoking Products", pp. 1, 11-14, 63-64; R. J. Reynolds Tobacco Company.

*Primary Examiner*—V. Millin
*Assistant Examiner*—J. Doyle
*Attorney, Agent, or Firm*—Kerkam, Stowell, Kondracki & Clarke

[57] ABSTRACT

Addition of strong, inorganic acids, such as phosphoric, sulfuric and hydrochloric, to regular, heavy-weight, and reduced sidestream smoke cigarette papers to give improved subjective taste properites, improved subjective sidestream aroma and reduced irritation properties to cigarettes.

12 Claims, No Drawings

WRAPPERS FOR SMOKING ARTICLES, METHODS OF MAKING SUCH WRAPPERS AND SMOKING ARTICLES MADE FROM SUCH WRAPPERS—CASE V

CROSS-REFERENCE TO RELATED APPLICATIONS

This application is a continuation-in-part of my application Ser. No. 07/514,533, filed Apr. 26, 1990.

Related subject matter is disclosed and claimed in my U.S. Pat. No(s). 5,065,777 and 5,107,864.

SUMMARY OF THE INVENTION

This invention relates to improved wrappers for smoking articles, to the method of making such wrappers and to smoking articles made from such wrappers.

The purpose of this invention is to impart improved subjective taste properties and sidestream aroma properties to cigarettes and other smoking articles. Smoking article wrappers of this invention have good appearance and high opacity, which, when fabricated into smoking articles with suitable tobacco columns and filter systems, statically burn at acceptable rates. Inorganic acid addition improves subjective taste properties and sidestream aroma properties with regular, heavy-weight, and low sidestream cigarette papers. The acid treatment can be used with:

(1) Normal and heavy-weight cigarette papers containing normal burning chemicals and/or thermally stable ash conditioners.

(2) Sidestream smoke reducing cigarette papers containing fillers, such as magnesium hydroxide and/or activated carbon with or without sugars to improve ash properties and which also contain normal types of burning chemicals and/or thermally stable ash conditioners.

BACKGROUND OF THE INVENTION

Extensive subjective taste studies have shown the taste characteristics of smoking articles wrapped in reduced sidestream smoke papers to have objectional taste characteristics relative to regular smoking articles. Additional studies have also shown that the pH of the mainstream smoke of tobacco columns wrapped in reduced sidestream smoke cigarette paper is higher than that of the same tobacco columns wrapped in regular cigarette paper. The subjective taste characteristics of cigarettes wrapped in reduced sidestream smoke cigarette paper are similar to that obtained when the pH of mainstream smoke of regular cigarettes is artificially increased. Prior studies have shown that the subjective taste characteristics of the low sidestream cigarettes are significantly improved by reducing the pH of the mainstream smoke.

Owens, U.S. patent application Ser. No. 514,533, filed Apr. 26, 1990, of which this application is a continuation-in-part, reveals the use of organic acids selected from the group of citric, malic, lactic, glycolic, tartaric, fumaric, maleic, malonic, glutaric, adipic, and succinic for treatment of reduced sidestream smoke cigarette papers, to give desirable subjective taste properties approaching that obtained with cigarettes wrapped with regular cigarette paper.

DETAILED DESCRIPTION OF THE INVENTION

It has now been discovered that certain strong inorganic acids, such as phosphoric, sulfuric, and hydrochloric, can be used to treat regular, heavy-weight, and reduced sidestream smoke cigarette papers to give improved subjective taste properties. Such inorganic acid treatment also gives improved subjective sidestream aroma and imparts reduced irritation properties to the smoke. This acid treatment can best be applied in combination with normal type cigarette paper burning chemicals as a size press addition to the base sheet; however, other methods of application can be used, such as printing the acid on the paper.

PARAMETERS OF THE INVENTION
(% of base weight of paper)

| | |
|---|---|
| Carbon Content: | 0.0% to 60% |
| Preferred | 0.0% to 25% |
| Magnesium Hydroxide Content: | 0.0% to 35% |
| Preferred | 0.0% to 25% |
| Calcium Carbonate Content: | 0.0% to 40% |
| Preferred | 0.0% to 30% |
| Basis Weight: | 15 g/m$^2$ to 100 g/m$^2$ |
| Preferred | 20 g/m$^2$ to 65 g/m$^2$ |
| Inherent Porosity: | 1 to 100 Coresta |
| Preferred | 5 to 75 Coresta |
| Burning Chemical: | alkali metal salts of organic and inorganic acids selected from the group consisting of citric, malic, lactic, glycolic, tartaric, fumaric, maleic, malonic, glutaric, adipic, acetic, succinic, phosphoric, hydrochloric, and sulfuric |
| Burning Chemical Content: | 0.5 to 90.0 (mg alkali metal |
| Preferred: | 2.0 to 50.0 per gram of base paper) |
| Acid Concentration of Burning Chemical Solution: | 0.01 to 2.0 molar |
| Preferred: | 0.02 to 1.0 molar |

This invention can be utilized with acid and flavor-treated carbon and sugar addition to the base paper. Also, this invention is effective with other reduced sidestream smoke cigarette papers with fillers, such as basic magnesium corbonate.

TABLE I

EFFECT OF BURNING CHEMICAL/ACID CONTENT OF BURNING CHEMICAL SOLUTION ON SUBJECTIVE TASTE AND AROMA
REGULAR CIGARETTE PAPER - BRAND A
Cigarette Paper: 25 g/m$^2$, 30% calcium carbonate, regular
Burning chemical type: as indicated
Burning chemical solution pick-up: 80% of dry weight of base sheet
Tobacco column: commercial lights 100's (Brand A)
Acid concentrations: sulfuric 96.5%, hydrochloric 37.25%

| Acid Type | Acid Conc. (Molarity) | Burning Chemical | Taste | Aroma |
|---|---|---|---|---|
| — | 0 | 3% $K_3$ Citrate | slightly harsh/ bitter, slight mouth coating/ aftertaste | harsh, eye/ nasal irritation |
| HCl | 0.063 | 3% $K_3$ Citrate | milder, no bitterness, no mouth coating/aftertaste | slightly reduced eye/ nasal irritation |
| HCl | 0.50 | 3% $K_3$ Citrate | mild, smooth, no bitterness, no mouth coating/ aftertaste | mild, reduced eye/nasal irritation |
| HCl | 0.50 | 3% KCl | mild, smooth, no | mild, reduced |

TABLE I-continued

EFFECT OF BURNING CHEMICAL/ACID CONTENT OF BURNING CHEMICAL SOLUTION ON SUBJECTIVE TASTE AND AROMA REGULAR CIGARETTE PAPER - BRAND A
Cigarette Paper: 25 g/m$^2$, 30% calcium carbonate, regular
Burning chemical type: as indicated
Burning chemical solution pick-up: 80% of dry weight of base sheet
Tobacco column: commercial lights 100's (Brand A)
Acid concentrations: sulfuric 96.5%, hydrochloric 37.25%

| Acid Type | Acid Conc. (Molarity) | Burning Chemical | Taste | Aroma |
|---|---|---|---|---|
| | | | bitterness, no mouth coating/ aftertaste | eye/nasal irritation |
| HCl | 0.61 | none | very mild, smooth, reduced tobacco taste, no mouth coating/ aftertaste | extremely mild, greatly reduced eye/ nasal irritation |
| $H_2SO_4$ | 0.12 | 3% $K_3$ Citrate | very mild, smooth, no bitterness, no mouth coating/aftertaste | mild, reduced eye/nasal irritation |
| $H_2SO_4$ | 0.12 | 3% KCl | very mild, smooth, no bitterness, no mouth coating/aftertaste | mild, reduced eye/nasal irritation |
| $H_2SO_4$ | 0.12 | none | very mild, smooth, no bitterness, no mouth coating/aftertaste, sweet note | mild, reduced eye/nasal irritation |
| HCl | 0.50 | none | very mild, smooth, no bitterness, no mouth coating/aftertaste | mild, reduced eye/nasal irritation |
| Malic | 0.15 | none | mild, smooth, slightly bitter, no mouth coating/ aftertaste, slightly dirty | mild, reduced eye/nasal irritation |
| Citric | 0.14 | none | mild, smooth, slightly bitter, no mouth coating/ aftertaste, slightly dirty | mild, reduced eye/nasal irritation |

The above Table I shows that the taste and aroma characteristics of the cigarette are dependent primarily on the total level of acid treatment of the paper and are not significantly impacted by the type nor level of burning chemical or ash conditioner applied to the paper.

TABLE II

EFFECT OF BURNING CHEMICAL AND ACID CONTENT OF BURNING CHEMICAL SOLUTION ON SUBJECTIVE TASTE AND AROMA REDUCED SIDESTREAM SMOKE CIGARETTE PAPER - BRAND A
Cigarette paper: 45 g/m$^2$, 10% magnesium hydroxide, 30% calcium carbonate, reduced sidestream
Burning chemical type: as indicated
Burning chemical solution pick-up: 80% of dry weight of base sheet
Tobacco column: commercial lights 100's (Brand A)
Acid Concentrations: sulfuric 96.5%, hydrochloric 37.25%

| Acid Type | Acid Conc. (Molarity) | Burning Chemical | Taste | Aroma |
|---|---|---|---|---|
| — | 0 | 6.5% $K_3$ Citrate | harsh, bitter, peppery, mouth coating/aftertaste | harsh, cigar-type, strong eye/nasal irritation |
| — | 0 | none | slightly harsh, slightly bitter, slightly peppery, slight mouth coating/aftertaste | milder, reduced eye/ nasal irritation |

TABLE II-continued

EFFECT OF BURNING CHEMICAL AND ACID CONTENT OF BURNING CHEMICAL SOLUTION ON SUBJECTIVE TASTE AND AROMA REDUCED SIDESTREAM SMOKE CIGARETTE PAPER - BRAND A
Cigarette paper: 45 g/m$^2$, 10% magnesium hydroxide, 30% calcium carbonate, reduced sidestream
Burning chemical type: as indicated
Burning chemical solution pick-up: 80% of dry weight of base sheet
Tobacco column: commercial lights 100's (Brand A)
Acid Concentrations: sulfuric 96.5%, hydrochloric 37.25%

| Acid Type | Acid Conc. (Molarity) | Burning Chemical | Taste | Aroma |
|---|---|---|---|---|
| Malic | 0.15 | none | mild, no bitterness, not peppery, no mouth coating/aftertaste | mild, reduced eye/nasal irritation |
| Citric | 0.14 | none | mild, slightly bitter, not peppery, no mouth coating/aftertaste | mild, reduced eye/nasal irritation |
| HCl | 0.50 | 3% $K_3$ Citrate | mild, smooth, no bitterness, slightly dirty, no mouth coating/aftertaste | mild, reduced eye/nasal irritation |
| HCl | 0.61 | none | very mild, smooth reduced tobacco taste, no mouth coating/aftertaste | extremely mild, greatly reduced eye/ nasal irritation |
| $H_2SO_4$ | 0.12 | none | very mild, smooth, no bitterness, no mouth coating/aftertaste, sweet note | extremely mild, greatly reduced eye/nasal irritation |

The above Table II shows the same trends for heavyweight, reduced sidestream cigarette paper taste and aroma characteristics that were found in Table I for regular cigarette paper. Again, these taste and aroma characteristics of the cigarette are dependent primarily on the total level of acid treatment of the paper and are not significantly impacted by the type nor level of burning chemical or ash conditioner applied to the paper. Indications are that combustible burning chemicals, such as potassium citrate, can also induce negative taste factors, especially at higher levels of treatment.

TABLE III

EFFECT OF BURNING CHEMICAL CONTENT AND ACID CONTENT ON SUBJECTIVE TASTE AND AROMA REDUCED SIDESTREAM SMOKE CIGARETTE PAPER - BRAND A
Cigarette paper: 45 gm/m$^2$, 10% magnesium hydroxide, 30% calcium carbonate, reduced sidestream
Burning chemical type: tri potassium citrate mono hydrate
Acid: Phosphoric
Tobacco column: commercial lights 100's (Brand A)

| Burning Chemical (mg/gm of base paper) | Acid Conc. (Molarity) | Taste | Aroma |
|---|---|---|---|
| 0% | 0 | harsh, bitter, mouth coating/aftertaste | harsh, cigar-like, eye/nasal irritation |
| 3 | 0.014 | reduced harshness, slightly bitter, reduced mouth coating/aftertaste | reduced irritancy, slightly reduced eye/nasal irritation |
| 6 | 0.045 | mild, slightly bitter, good tobacco taste, slight mouth coating/aftertaste | mild, low irritation, reduced eye/nasal burn |
| 9 | 0.099 | very mild, no bitter taste, good tobacco taste, smooth | very mild, cigarette-like, low irritation, reduced eye/nasal |

TABLE III-continued

EFFECT OF BURNING CHEMICAL CONTENT AND ACID CONTENT ON SUBJECTIVE TASTE AND AROMA REDUCED SIDESTREAM SMOKE CIGARETTE PAPER - BRAND A
Cigarette paper: 45 gm/m$^2$, 10% magnesium hydroxide, 30% calcium carbonate, reduced sidestream
Burning chemical type: tri potassium citrate mono hydrate
Acid: Phosphoric
Tobacco column: commercial lights 100's (Brand A)

| Burning Chemical (mg/gm of base paper) | Acid Conc. (Molarity) | Taste | Aroma |
|---|---|---|---|
| | | | burn |
| 12* | 0.12 | very mild, smooth, good tobacco taste, no mouth coating/aftertaste | very mild, low irritation reduced eye/nasal burn |
| 14* | 0.15 | very mild, smooth, good tobacco taste, no mouth coating/aftertaste | mild, low irritation, reduced eye/nasal burn |
| 19 | 0.19 | mild, slightly bitter, reduced tobacco taste | mild, low irritation, reduced eye/nasal burn |

*Considered to have best overall taste and aroma characteristics.

Additional studies reported in this application show that the taste and aroma improvements are primarily a function of acid content with high levels of burning chemical contributing to off-taste characteristics, generally described as bitter. The above results show that, for this specific reduced sidestream cigarette paper, burning chemical levels in the range of 19 mg/gm of base paper contribute to a bitter taste which is characteristic of high-burning chemical levels.

TABLE IV

EFFECT OF BURNING CHEMICAL CONTENT AND ACID CONTENT ON SUBJECTIVE TASTE AND AROMA REGULAR CIGARETTE PAPER - BRAND A
Cigarette paper: 25 g/m$^2$, 30% calcium carbonate, regular
Burning chemical type: tri potassium citrate mono hydrate
Acid: Phosphoric
Tobacco column: commercial lights 100's (Brand A)

| Potassium Citrate (mg/gm of base paper) | Acid Conc. (Molarity) | Taste | Aroma |
|---|---|---|---|
| 0% (control) | 0 | bitter, mild nasal irritation, dry mouth coating/aftertaste | harsh, eye/nasal irritation |
| 3 | 0.014 | slightly milder/bitter dry aftertaste | harsh, eye/nasal irritation |
| 6 | 0.045 | mild, no bitter aftertaste, low nasal irritation | mild, reduced eye/nasal irritation |
| 9* | 0.099 | mild, smooth, no bitterness, slightly sweet, good tobacco taste | very mild, greatly reduced eye/nasal irritation |
| 12 | 0.12 | very mild, no bitterness, very smooth, reduced tobacco taste | very mild, reduced eye/nasal irritation, reduced tobacco aroma |
| 14 | 0.15 | slightly bitter, mild, very smooth, greatly reduced taste | very mild, greatly reduced tobacco aroma |
| 19 | 0.19 | slightly bitter, mild, smooth, greatly reduced tobacco taste | slightly irritating/harsh, greatly reduced tobacco aroma |
| 0 | 1.02 | very mild, no bitterness, smooth, reduced tobacco taste | very mild, reduced eye/nasal irritation |
| 0 | 2.04 | mild, slightly dry, | mild, less irritat- |

TABLE IV-continued

EFFECT OF BURNING CHEMICAL CONTENT AND ACID CONTENT ON SUBJECTIVE TASTE AND AROMA REGULAR CIGARETTE PAPER - BRAND A
Cigarette paper: 25 g/m$^2$, 30% calcium carbonate, regular
Burning chemical type: tri potassium citrate mono hydrate
Acid: Phosphoric
Tobacco column: commercial lights 100's (Brand A)

| Potassium Citrate (mg/gm of base paper) | Acid Conc. (Molarity) | Taste | Aroma |
|---|---|---|---|
| | | slight mouth coating/aftertaste, no bitterness | ing reduced eye/nasal irritation |

*Considered to have best overall taste and aroma characeristics.

Additional studies reported in this application show that the taste and aroma improvements are primarily a function of acid content with high levels of burning chemical contributing to off-taste characteristics, generally described as bitter. The above results show that, for regular cigarette paper, burning chemical concentrations above 14 mg/gm of base paper contribute to a bitter taste characteristic. AT an acid treatment concentration in the range of 2 molar, negative taste characteristics were observed.

TABLE V

EFFECT OF BURNING CHEMICAL CONTENT AND ACID CONTENT ON SUBJECTIVE TASTE AND AROMA HEAVY-WEIGHT CIGARETTE PAPER - BRAND A
Cigarette paper: 45 gm/m$^2$, 28% calcium carbonate, heavy-weight
Burning chemical type: tri potassium citrate mono hydrate
Acid: phoshoric
Tobacco column: commercial lights 100's (Brand A)

| Burning Chemical (mg/gm of base paper) | Acid Conc. (Molarity) | Taste | Aroma |
|---|---|---|---|
| 3 (control) | 0 | peppery, harsh, good tobacco taste | harsh, irritating, cigar-like |
| 3 | 0.014 | peppery, slightly harsh, good tobacco taste | slightly irritating, burning paper note |
| 6 | 0.045 | peppery, woody, slightly harsh, reduced tobacco taste | slightly irritating, burning paper note |
| 9 | 0.099 | peppery, mild, papery, reduced tobacco taste | slightly irritating, burning paper note |
| 12 | 0.12 | peppery, papery, reduced tobacco taste | slightly irritating, burning paper note, reduced tobacco aroma |
| 14 | 0.15 | peppery, slightly harsh, greatly reduced tobacco taste | slightly irritating, burning paper note, greatly reduced tobacco aroma |
| 19 | 0.19 | smooth, greatly reduced tobacco taste, mild | very mild, greatly reduced tobacco aroma |
| 9* | 0.28 | smooth, mild, good tobacco taste | reduced irritation, normal cigarette aroma |
| 9* | 0.41 | very mild, smooth, good tobacco taste | greatly reduced irritation, normal cigarette aroma |
| 9 | 0.73 | extremely mild, reduced tobacco taste | greatly reduced irritation, reduced cigarette aroma |

*Considered to have best overall taste and aroma characteristics.

The above results recorded in Table V demonstrate, for certain types of paper, a higher acid content burning chemical solution is required to give improved taste and aroma characteristics similar to that obtained from tests delineated in Tables III and IV.

TABLE VI

COMPARATIVE TASTE/AROMA CHARACTERISTICS USING SULFURIC, HYDROCHLORIC AND PHOSPHORIC ACIDS
REGULAR CIGARETTE PAPER - BRAND A
Cigarette paper: 25 gm/m$^2$, 30% calcium carbonate, regular
Burning chemical type: tri potassium citrate mono hydrate
Tobacco column: commercial lights 100's (Brand A)

| Burning Chemical (mg/gm of base paper) | Acid Type | Acid Conc. (Molarity) | Taste | Aroma |
|---|---|---|---|---|
| 3 | None | 0 | slightly bitter/metallic/slight mouth coating aftertaste | harsh, irritating, nasal/eye burn |
| 3 | Sulfuric | 0.013 | milder, less bitter, less aftertaste/mouth coating | milder, less irritating |
| 9* | Sulfuric | 0.023 | much milder, smoother, no bitterness, slightly sweet, no aftertaste | much milder, less irritating |
| 19 | Sulfuric | 0.087 | slightly bitter, slightly harsh, slight mouth coating/aftertaste | much milder, less irritating |
| 3* | Hydrochloric | 0.027 | very mild, smooth, no mouth coating/aftertaste | milder, less irritating |
| 9* | Hydrochloric | 0.063 | extremely mild, very smooth, no bitterness, no mouth coating/aftertaste | extrexmely mild, minimal irritation |
| 19 | Hydrochloric | 0.14 | very mild, smooth, slightly bitter, slight aftertaste | increased harshness, increased eye/nasal irritation |
| 3 | Phosphoric | 0.014 | mild, smooth, no mouth coating/aftertaste | milder, less irritating |
| 9* | Phosphoric | 0.099 | very mild, smooth, no mouth coating/aftertaste | very mild, minimal eye/nasal irritation |
| 19 | Phosphoric | 0.19 | very mild, smooth, slightly bitter, no mouth coating/aftertaste | mild, less irritating |

*Considered to have best overall taste and aroma characteristics.

Similar taste properties are observed with sulfuric, hydrochloric and phosphoric acids. Optimum taste/aroma properties were noted when the alkali metal burning chemical content was in the range of 3 to 9 mg/gm of base paper and acid concentration was in the range of 0.27 to 0.63 molar.

TABLE VII

EFFECT OF BURNING CHEMICAL AND ACID CONTENT ON SUBJECTIVE TASTE AND AROMA
REGULAR CIGARETTE PAPER - BRAND B
Cigarette paper: 25 gm/m$^2$, 30% calcium carbonate, regular
Burning chemical type: tri potassium citrate mono hydrate
Tobacco column: commercial lights 100's (Brand B)
Acid: Hydrochloric

| Burning Chemical (mg/gm of base paper) | Acid Conc. (Molarity) | Taste | Aroma |
|---|---|---|---|
| 3 (control) | 0.0 | mild, smooth, slightly bitter, slight metallic, slight aftertaste, no mouth coating | harsh, irritating, eye/nasal sting |
| 3 | 0.27 | mild, smooth, slightly bitter, slightly metallic, slight aftertaste, no mouth coating | reduced irritation milder |
| 9 | 0.063 | mild, smooth, more bitter, slightly metallic, slight aftertaste, no mouth coating | reduced irritation reduced eye/nasal sting |
| 19 | 0.14 | slightly harsher, bitter, slightly metallic, slight aftertaste | harsh, irritating, eye/nasal sting |
| 3* | 0.19 | very mild, smooth, no bitterness, no mouth coating/aftertaste | very mild, less irritating, reduced eye/nasal sting |
| 3* | 0.50 | extremely mild, smooth, no bitterness, no mouth coating/aftertaste | extremely mild, much less irritation |
| 3 | 0.58 | extremely mild, smooth, reduced tobacco taste, no mouth coating/aftertaste | very mild, much less irritating |

*Considered to have best overall taste and aroma characteristics.

The above table shows, in comparison to Table VI, that different tobacco columns may require different levels of burning chemical and acid addition to achieve optimum taste and aroma characteristics.

TABLE VIII

EFFECT OF BURNING CHEMICAL AND ACID CONTENT ON SUBJECTIVE TASTE AND AROMA
REGULAR CIGARETTE PAPER - BRAND C
Cigarette paper: 25 gm/m$^2$, 30% calcium carbonate, regular
Burning chemical type: tri potassium citrate mono hydrate
Tobacco column: commercial unfiltered king size - 85 mm (Brand C)
Acid: Hydrochloric

| Burning Chemical (mg/gm of base paper) | Acid Conc. (Molarity) | Taste | Aroma |
|---|---|---|---|
| 3 (control) | 0 | very bitter, harsh, mouth coating/aftertaste, hot/peppery | very harsh, irritating, eye/nasal burn |
| 3 | 0.027 | bitter, harsh, slightly milder than control, mouth coating/aftertaste | milder than control, but still very irritating to eyes and nose |
| 9 | 0.063 | similar to control, bitter aftertaste/mouth coating, peppery | mild, less irritating than control |
| 19 | 0.14 | bitter, harsh, mouth coating/aftertaste | mild, less irritating |
| 9* | 0.19 | very mild, smooth, | mild, much less |

TABLE VIII-continued

EFFECT OF BURNING CHEMICAL AND ACID CONTENT ON SUBJECTIVE TASTE AND AROMA REGULAR CIGARETTE PAPER - BRAND C

Cigarette paper: 25 gm/m$^2$, 30% calcium carbonate, regular
Burning chemical type: tri potassium citrate mono hydrate
Tobacco column: commercial unfiltered king size - 85 mm (Brand C)
Acid: Hydrochloric

| Burning Chemical (mg/gm of base paper) | Acid Conc. (Molarity) | Taste | Aroma |
|---|---|---|---|
| | | good tobacco taste, no bitterness, no mouth coating/ aftertaste | irritating |
| 9* | 0.50 | very mild, smooth, good tobacco taste, no bitterness, no mouth coating/ after taste | very mild, less irritating to eyes and nose |
| 9 | 0.58 | very mild, reduced tobacco taste, no bitterness, no after-taste/mouth coating | extremely mild, less irritating to eyes and nose |

*Considered to have best overall taste and aroma characteristics.

The above table shows, in comparison to Table VI, that different tobacco columns may require different levels of burning chemical and acid addition to achieve optimum taste and aroma characteristics.

I claim:

1. A wrapper for smoking articles, comprising a cellulosic sheet, inorganic filler in said sheet and a strong inorganic acid coated on at least the inner surface of the sheet.

2. The wrapper, as defined in claim 1, wherein the acid is selected from the group consisting of phosphoric, sulfuric, and hydrochloric acid.

3. The wrapper, as defined in claim 2, wherein the acid is applied at the size press with a burning chemical solution.

4. The wrapper, as defined in claim 3, wherein the acid concentration of the burning chemical solution is in the range of 0.01 to 2.0 molar.

5. The method, as defined in claim 1, further including adjusting the said solution to contain an acid concentration in the range of 0.01 to 2.0 molar.

6. A smoking article comprising a tobacco charge and a wrapper for the tobacco charge, said wrapper comprising a cellulosic sheet, inorganic fillers in said sheet and a strong, inorganic acid coated on at least the inner surface of the sheet.

7. The smoking article, as defined in claim 6, wherein the acid is selected from the group consisting of phosphoric, sulfuric and hydrochloric acid.

8. The smoking article, as defined in claim 7, wherein the acid is applied at the size press in a burning chemical solution.

9. The smoking article, as defined in claim 8, wherein the wrapper is treated with a burning chemical solution which contains an acid in the concentration range of 0.01 to 2.0 molar.

10. A method of improving the taste characteristics of smoking articles, the steps: forming a cellulosic sheet having inorganic fillers therein and coating a strong inorganic acid on at least the inner surface of the sheet, and wrapping the coated sheet about a tobacco column.

11. The method, as defined claim 10, wherein the inorganic acid is selected from the group consisting of phosphoric, sulfuric and hydrochloric acid.

12. The method, as defined in claim 11, adding the acid at the size press with a burning chemical solution.

* * * * *